US007360916B2

(12) United States Patent
Sanborn et al.

(10) Patent No.: US 7,360,916 B2
(45) **Date of Patent: *Apr. 22, 2008**

(54) UNDER-CABINET LIGHT FIXTURE

(75) Inventors: Theodore R. Sanborn, Los Angeles, CA (US); Frank Tsao, Taipei Hsien (TW)

(73) Assignee: American Lighting, Inc., Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/623,245

(22) Filed: Jan. 15, 2007

(65) Prior Publication Data

US 2007/0121314 A1 May 31, 2007

Related U.S. Application Data

(63) Continuation of application No. 11/004,574, filed on Dec. 3, 2004, now Pat. No. 7,163,310.

(60) Provisional application No. 60/527,148, filed on Dec. 5, 2003.

(51) Int. Cl.
*F21V 21/08* (2006.01)
*F21V 33/00* (2006.01)

(52) U.S. Cl. ..... 362/133; 362/33; 362/223; 362/374; 312/223.5

(58) Field of Classification Search ..... 362/133, 362/33, 223, 374, 367, 224, 240, 127, 219, 362/251, 295, 375, 394, 455; 312/223.5
See application file for complete search history.

(56) References Cited

U.S. PATENT DOCUMENTS

| | | | | |
|---|---|---|---|---|
| 5,426,572 | A | 6/1995 | Weinstock et al. | 362/133 |
| 5,769,529 | A | 6/1998 | Weinstock et al. | 362/133 |
| 6,050,708 | A | 4/2000 | Roorda | 362/375 |
| 6,390,652 | B1 * | 5/2002 | Echito | 362/374 |
| 6,431,722 | B1 | 8/2002 | Benensohn | 362/133 |
| 6,508,566 | B1 | 1/2003 | Roorda | 362/133 |
| 6,565,234 | B1 | 5/2003 | Skegin et al. | 362/294 |
| 6,585,393 | B1 | 7/2003 | Brandes et al. | 362/249 |
| 6,755,551 | B2 * | 6/2004 | Soorus et al. | 362/221 |
| 7,163,310 | B2 | 1/2007 | Sanborn et al. | 362/656 |

* cited by examiner

*Primary Examiner*—Y Quach Lee
*Assistant Examiner*—Leah S Lovell
(74) *Attorney, Agent, or Firm*—Sheridan Ross P.C.

(57) ABSTRACT

An under-cabinet lighting fixture includes at least one bulb of less than about 35 watts contained within a housing that is devoid of any dedicated heat dissipation back vents on the back or top of the lighting unit. The lighting fixture has a reflective coating applied to the interior of the housing unit itself, which acts as a mirrored surface to reflect the bulb's illumination. A glass lens is supported by a metal frame that runs around the periphery of such lens and the lens cover itself is connected to the housing by pivoting hinges and is held in place when closed by one or more securing elements.

28 Claims, 8 Drawing Sheets

UNDER-CABINET LIGHT FIXTURE

CROSS-REFERENCE TO RELATED APPLICATIONS

This is a continuation of U.S. patent application Ser. No. 11/004,574, filed on Dec. 3, 2004, issuing as U.S. Pat. No. 7,163,310, which claims priority from U.S. Provisional Patent Application No. 60/527,148 filed Dec. 5, 2003.

FIELD OF THE INVENTION

The present invention pertains generally to the field of lighting fixtures and more particularly is directed to a fixture for mounting to the underside of a cabinet.

BACKGROUND OF THE INVENTION

Counter light fixtures constitute a substantial segment of the indoor lighting market and generally include lamp fixtures that can be mounted to the underside of wall-mounted cabinets, such as kitchen cabinets, for the purpose of illuminating a counter area under the cabinets. It is desirable that such counter lights have a slim profile for unobtrusive mounting under the cabinets. Many such fixtures are commercially available and typically rely on fluorescent lamp tubes as the light source. Counter lights are generally between one and two inches in height and of varying length depending on the length of the counter surface to be illuminated. Such light fixtures are commonly fastened by screws passing through mounting holes in the housing of the light fixture and driven into the wooden cabinet. Electrical power may be supplied to the fixture either by a power cord which is plugged into an A.C. wall outlet, or by an electrical conduit connected through a "knock-out" opening in the fixture housing.

In recent years, accent lighting has become popular in home decorating. In one form of this accent lighting, strings of low voltage incandescent lights have been mounted beneath kitchen cabinets. See for example U.S. Pat. No. 5,426,572 to Weinstock, et al. Other under-cabinet light fixture designs have venting apertures to disperse heat build-up, as well as heat-shield components (in addition to reflectors), and flexible barrier walls that need to be pressed to access wiring. See, e.g., U.S. Pat. Nos. D452,340 and 6,565,234 to Skegin. The cost of such fixtures, however, is increased due to the added heat shield component, the vents (and partition engaging holes) permit undesired light leakage through the top of the fixture, and access to wiring is awkward due to the need to press metal walls to disconnect partitions. There is therefore a long-felt, but unsolved need for a cost effective light fixture that eliminates the above-referenced problems encountered with prior art fixtures.

SUMMARY OF THE INVENTION

The present invention is directed to an improved counter light fixture having a housing which includes a housing cover extending between opposite end caps. Instead of traditional light fixtures having a separate reflector or a heat-shield plate and a reflector combination (see, e.g. U.S. Pat. No. 6,565,234 to Skegin, et al.) the present invention does away entirely with any separate heat shield plate or separate reflector. Instead, the present invention uses a reflective interior of the enclosed housing as the means by which to reflect light emanating from bulbs within the unit. Moreover, while other prior art devices use L-shaped partitions that must be pressed to engage or disengage with holes in the housing (see, e.g. Skegin et al), the present invention relies upon a simple cover plate that can be readily removed to permit access to wiring of the unit. Moreover, in contrast to other prior art devices, the present invention does not include an unsightly screw knob on the lens panel covering the light bulbs, but instead, includes an extended smooth surface of either glass or metal. The lens cover pivots and clips into place to secure a translucent surface through which light emanates when the bulbs of the unit are activated. In addition, in contrast to prior art units, the present invention, in a preferred embodiment, does away entirely with any vents in the housing, previously required on prior art designs to dissipate the heat generated by such prior art units. The absence of vents not only renders the present units far more structurally sound, reduces manufacturing costs and errors, but also avoids problems experienced with prior art devices when undesired material falls through vents and into the interior of the lighting units. The absence of vents also adds to the sleek and stylistic design of the present invention and prevents undesired light leakage from the top of the fixtures, making such units far more commercially desirable.

Instead of simply using a frangible and breakable glass panel to cover the bulbs, the present invention preferably utilizes a metal framed diffuser lens (which has glass components) to add structural integrity to the unit and to further enhance the desired sleek appearance thereof. The metal frame prevents the chipping of glass panels. Preferably the metal rimmed glass panel is slightly spaced from the front of the housing top, and the panel rear edge is spaced from an interior partition, thereby defining a front air gap and a rear air gap respectively to admit air flow to cool the housing during operation of the light fixture.

The molded plastic end caps preferably have knockouts that are removable for opening one or more holes and admitting electrical wiring into the wiring compartment to supply power to the light fixture.

The counter lamp fixture can be easily made in different lengths using the same end caps. Unlike prior art fixtures, there is no need for separate reflectors or heat shield assemblies along the length of the fixture. Instead, essentially the entire housing interior is adapted to reflect light from illuminated bulbs without the need for individual reflectors being mounted inside the unit.

These and other features, advantages and improvements of the present invention will be better understood from the following detailed description of the preferred embodiments taken in conjunction with the accompanying drawings.

DETAILED DESCRIPTION

Figure 1:
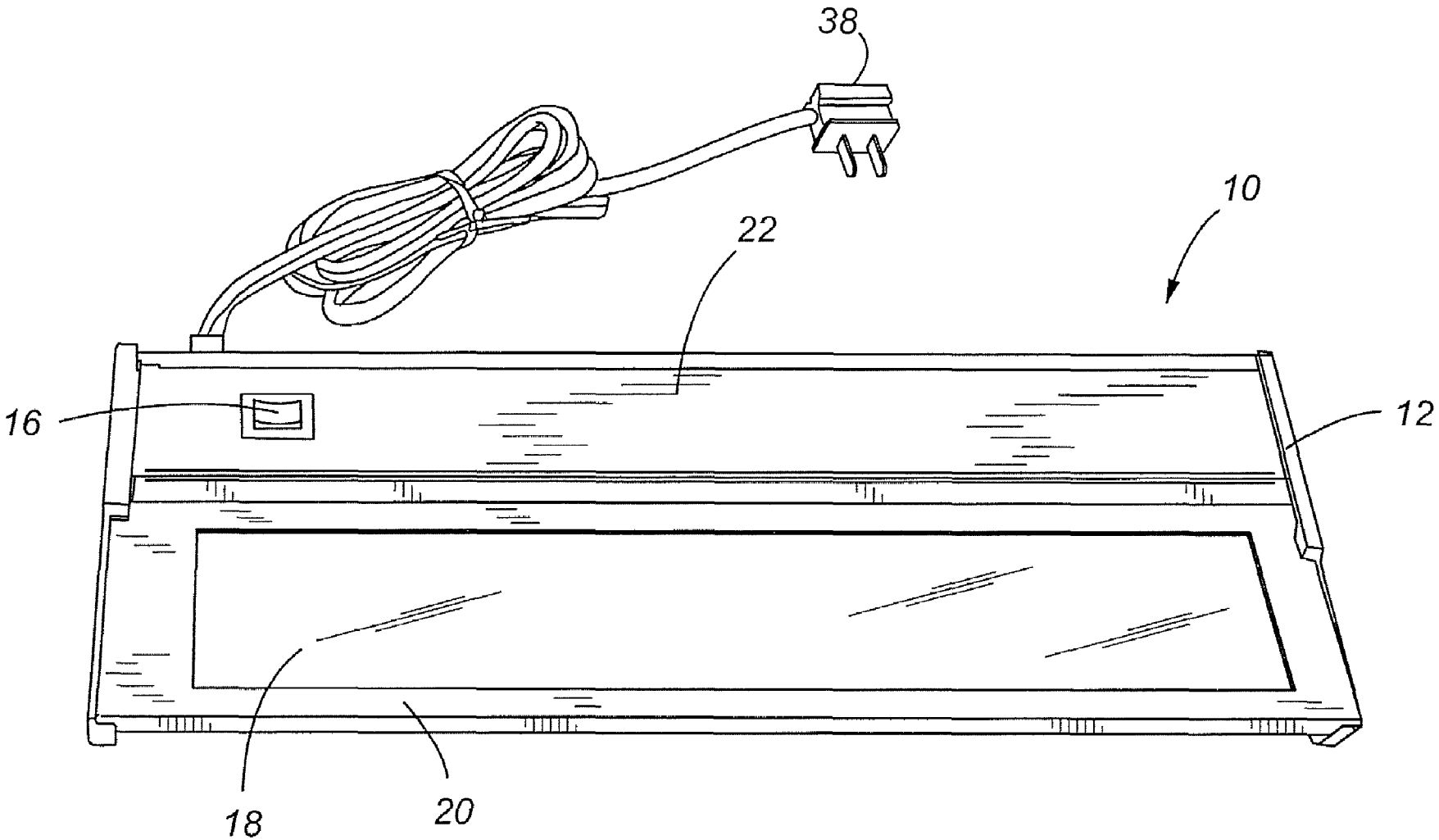
FIG. 1 is a perspective view of a under counter light fixture according to the present invention having a power cord.
Figure 2:
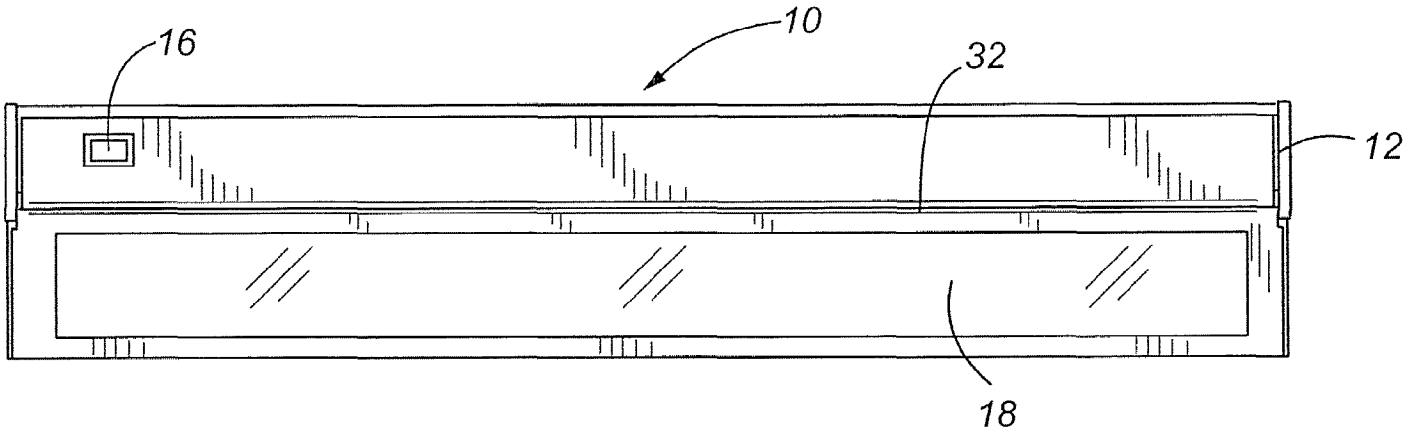
FIG. 2 is a perspective view of a under counter light fixture according to the present invention without a power cord.
Figure 3:
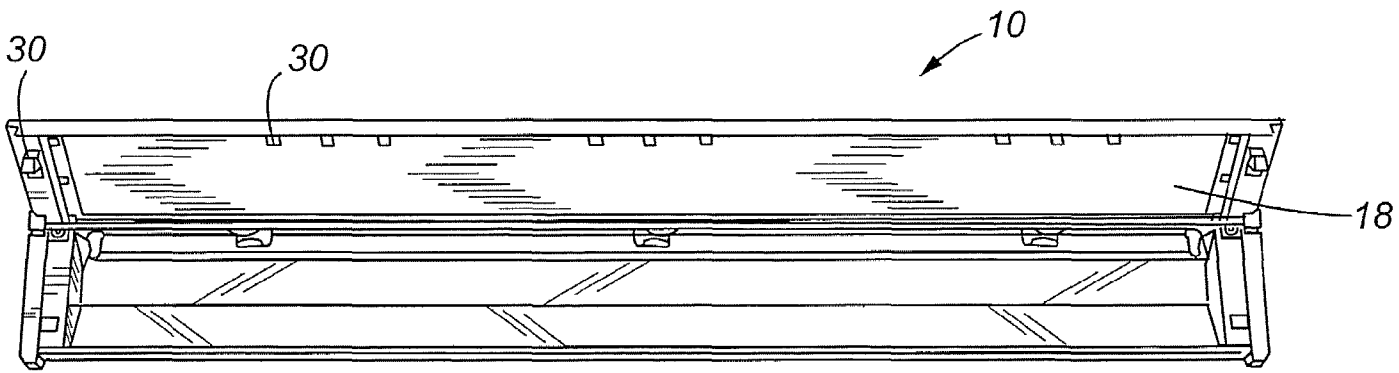
FIG. 3 is a front view of the device of FIG. 2 with the lens in an open position.
Figure 4:
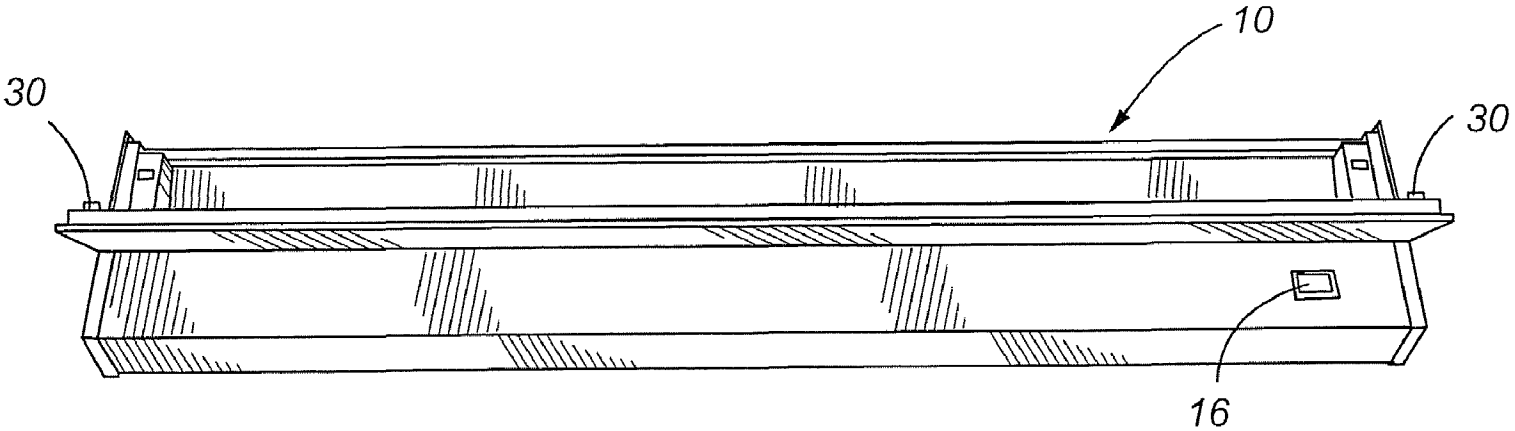
FIG. 4 is a back view of the device of FIG. 2 with the lens in an open position.
Figure 5:
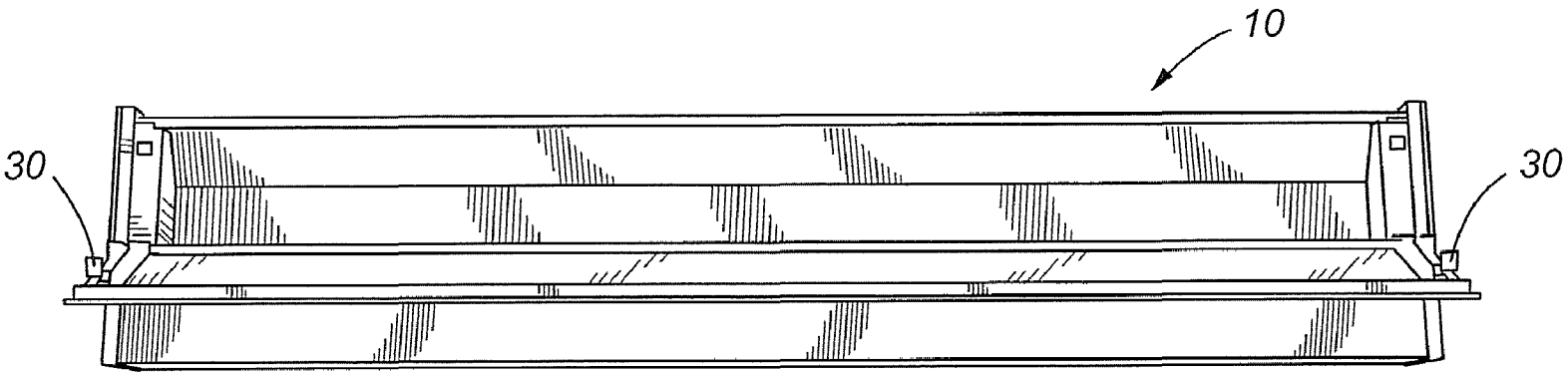
FIG. 5 is another back view of the device of FIG. 2.
Figure 6:
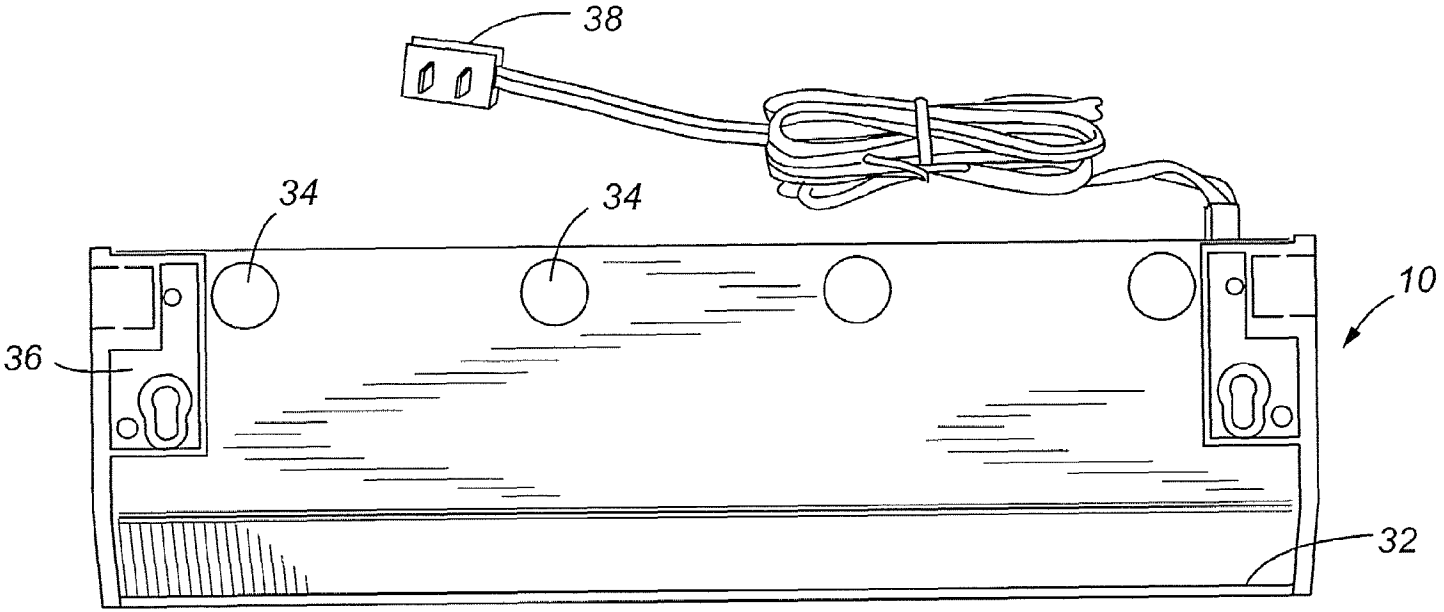
FIG. 6 is a top view of the device in FIG. 1.
Figure 7:
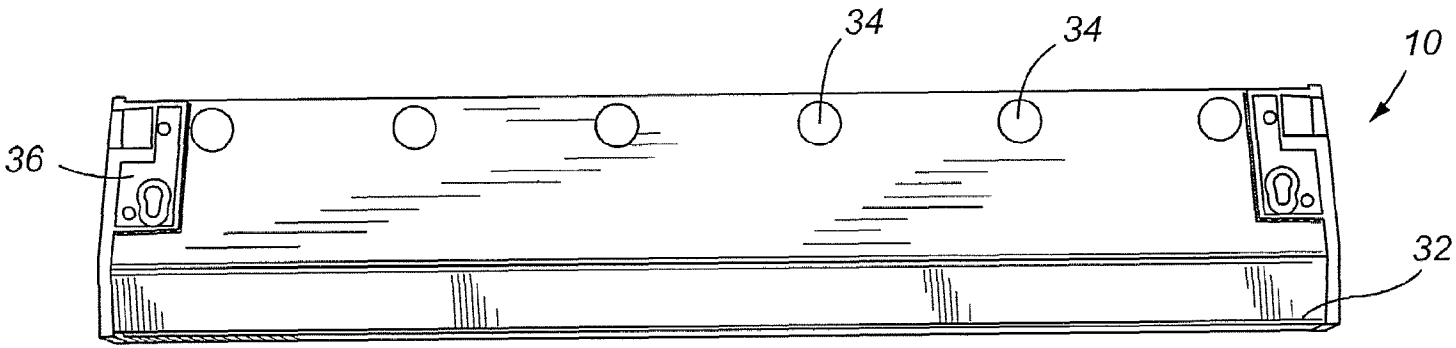
FIG. 7 is a top view of the device in FIG. 2.
Figure 8:
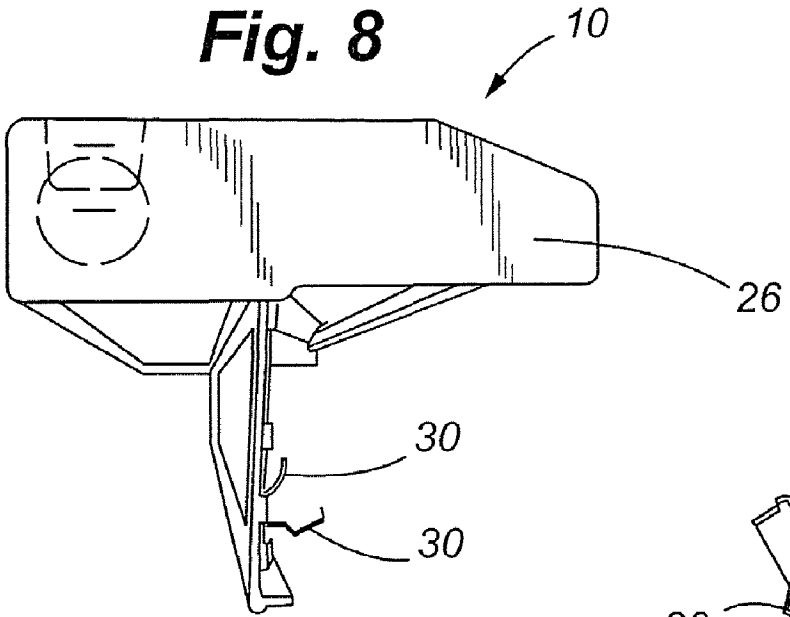
FIG. 8 is a side view of the device shown in FIG. 3.
Figure 9:
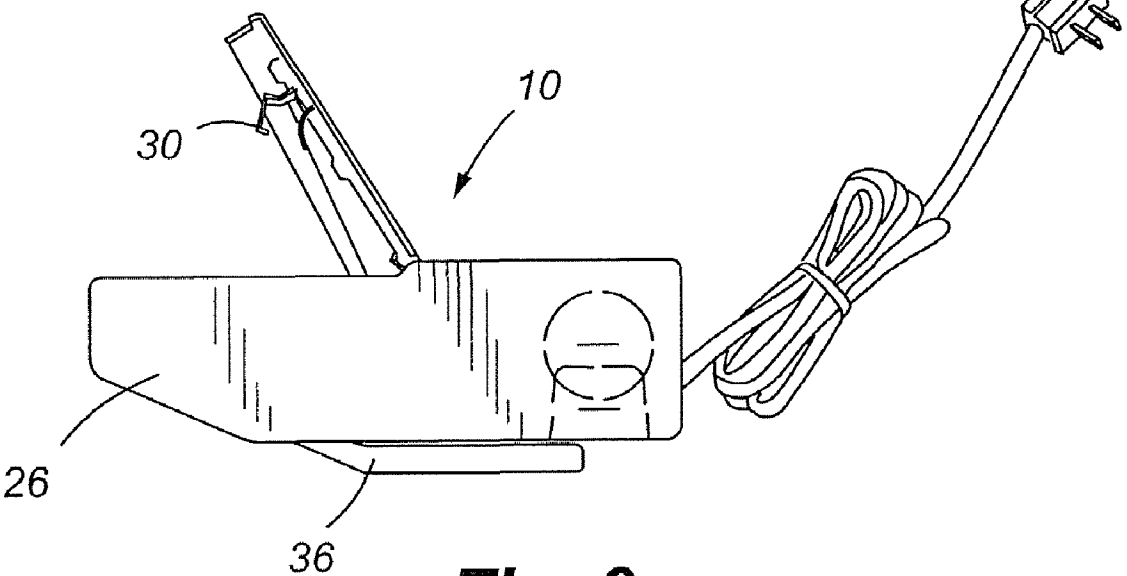
FIG. 9 is a side view of the device shown in FIG. 1.
Figure 10:
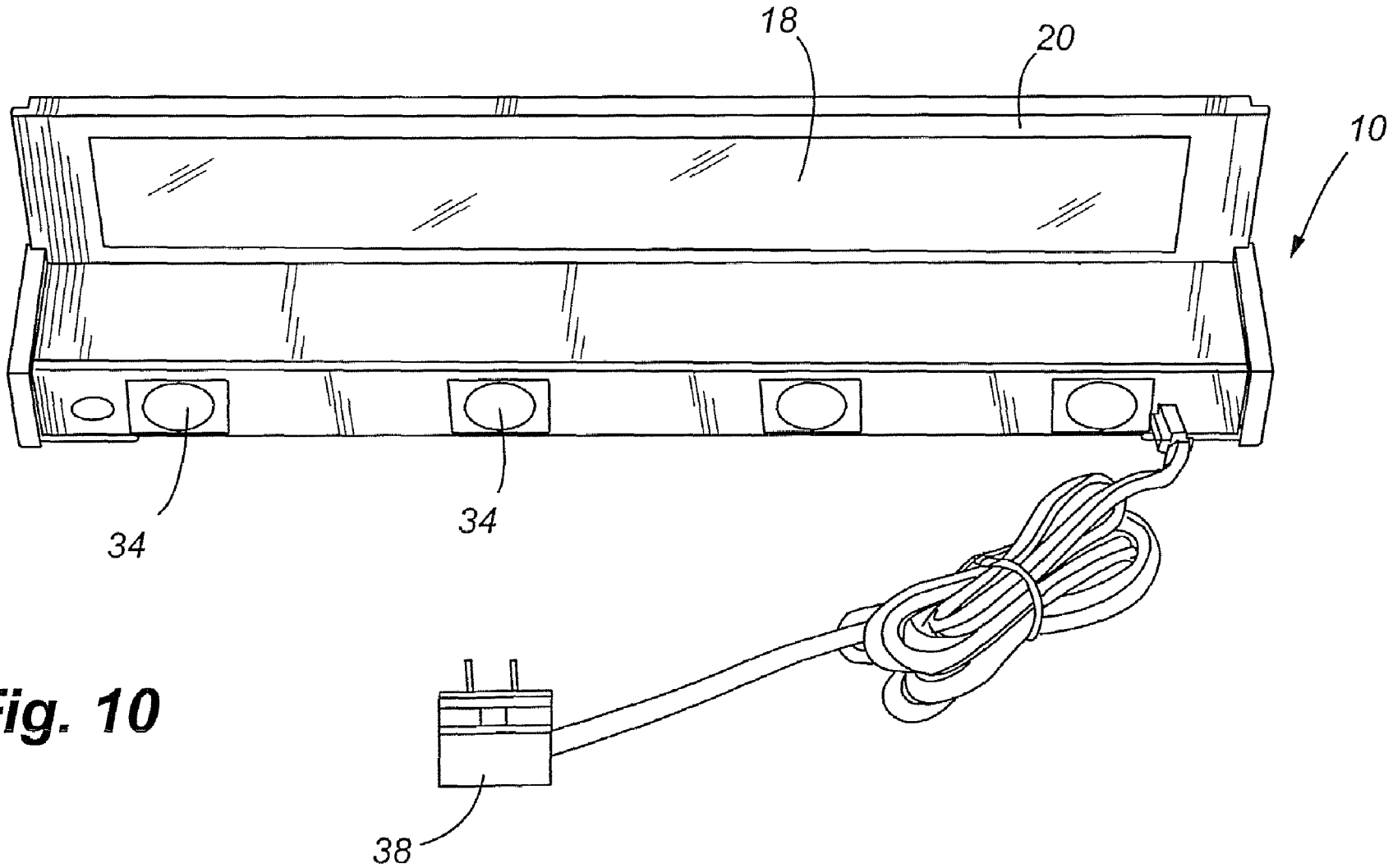
FIG. 10 is a back perspective view of the device of FIG. 1.
Figure 11:
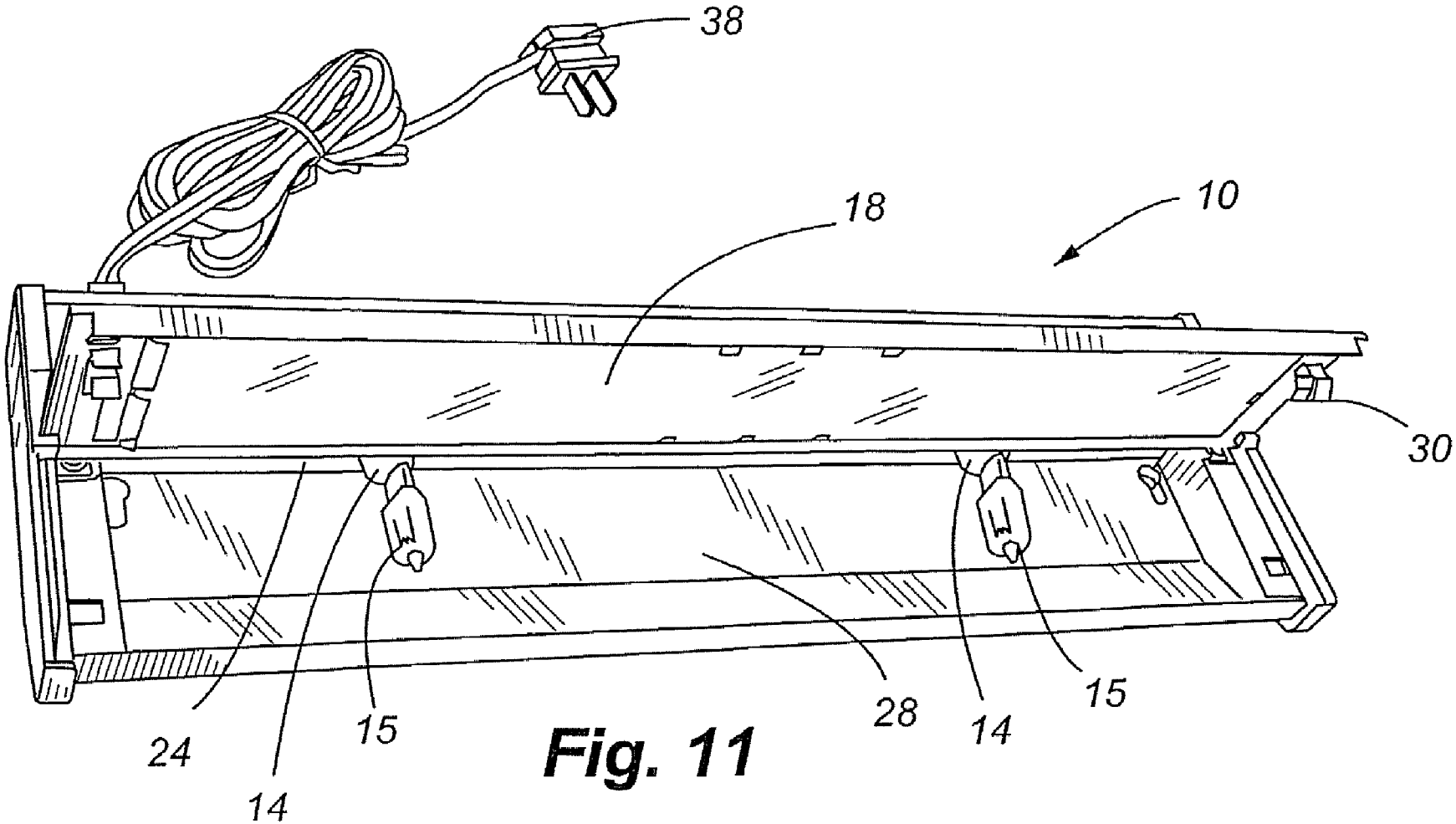
FIG. 11 is a front perspective view of the device of FIG. 1 with the lens in an open position.
Figure 12:
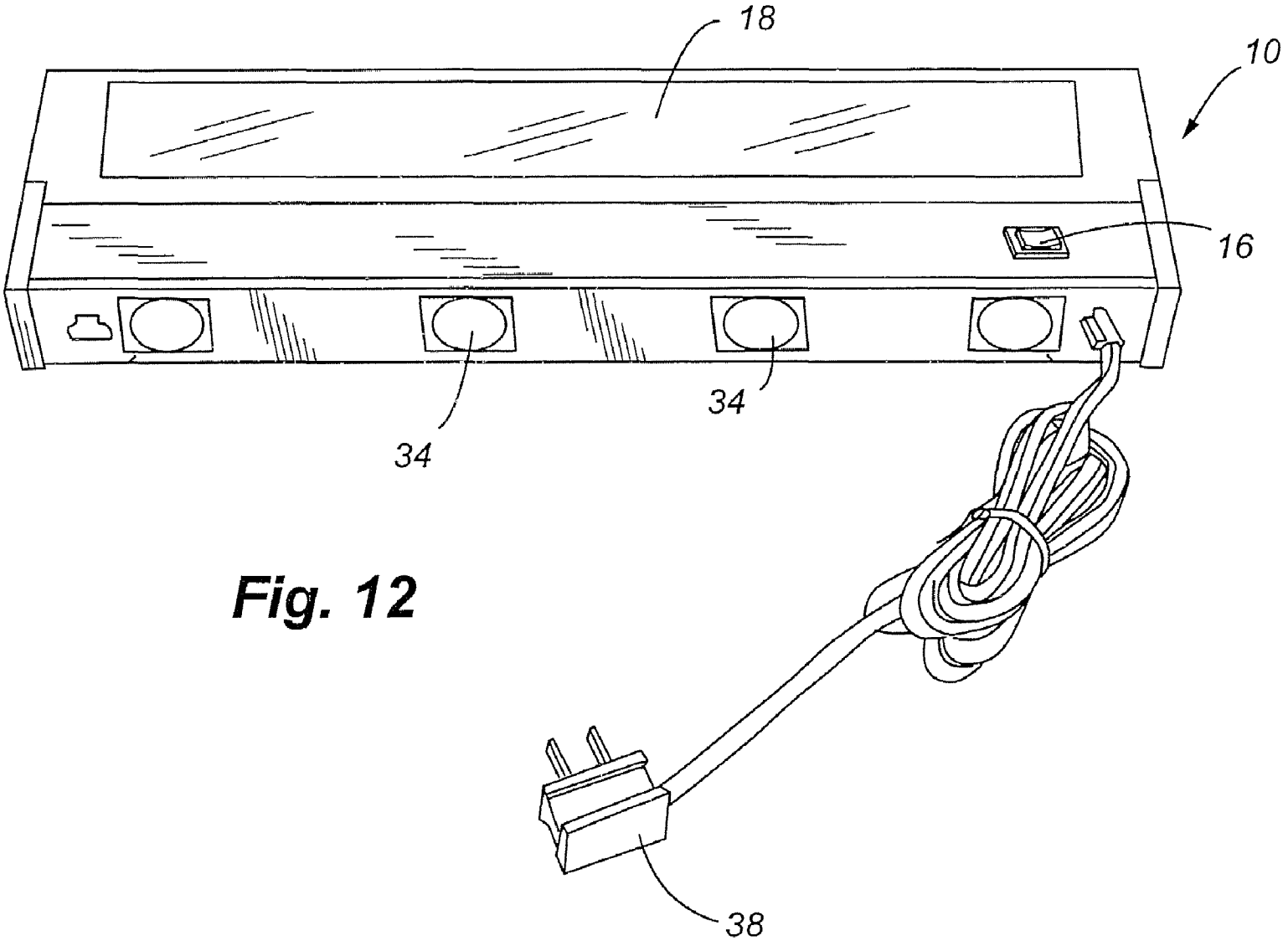
FIG. 12 is a back perspective view of the device shown in FIG. 1.

In one embodiment of the present invention a light fixture 10 comprises a generally rectangular metal housing 12, lamp assemblies 14 mounted inside the housing and a manually actuable rocker switch 16 mounted to the housing for controlling the energization of the lamp assemblies 14. The housing 12 has an elongated, thin low profile shape so that it will not be visible when mounted to the underside of a cabinet. The lamp assemblies 14 point downwardly and thus provide accent illumination on the countertop (not illustrated) below the cabinet.

The housing 12 is preferably made of stamped sheet metal. The lamp assemblies 14 are mounted in an interior of the housing 12. A clear or frosted diffusing lens 18 is preferably used to cover the light bulbs 15, preferably with a metal frame 20 surrounding and supporting such lens 18. A manually actuable rocker switch 16 is mounted in an aperture in the metal cover 22. The switch 16 is connected to the bulbs of the lamp assemblies 14 for controlling the energization thereof. Preferably the switch 16 has a three-position rocker arm that may be used to manually select OFF and two levels of brightness.

For ease of description as to various aspects of the present invention and to satisfy any written description or enablement concerns, the following U.S. Patents are incorporated herein in their entireties by this reference: U.S. Pat. No. 6,565,234 to Skegin, et al.; U.S. Pat. No. 6,050,708 to Roorda; U.S. Pat. No. 6,585,393 to Brandes et al.; U.S. Pat. No. 5,426,572 Weinstock, et al.; U.S. Pat. No 6,508,566 to Roorda; U.S. Pat. No. 6,431,722 to Benensohn; and U.S. Pat. No. 5,769,529 to Weinstock, et al.

In one embodiment, the present invention has no ventilation vents provided in the housing 12 itself. This is made possible due to the unique construction of the present invention, preferably using 120 volt xenon (20 watt) bulbs 15 or 35 watt halogen bulbs 15. Moreover, unlike prior art designs, the present lighting unit 10 provides an inner housing wall 24 that is not removable, thus adding to the safety features of the present invention over the prior art. The wiring for the bulbs 15 is accessed without removing a vertical wall, but rather, is accessed by disconnecting a cover 22 over the top of the wire containing compartment. In a preferred embodiment, the cover is attachable to the housing by means of threaded screws, with such screws being removable to access the wiring during mounting operations. The side panels 26 of the present invention are preferably of an angled configuration, rather than rounded. Instead of a separate reflector being necessary, the inside of a preferred embodiment of the present lighting fixture 10 is provided with a reflective coating 28 (e.g., by painting, etc.) so that the entire interior portion of the lighting unit acts as a reflector.

The glass lens 18 overlying the bulbs is supported by a metal frame 20 that runs around the periphery of the glass. In a preferred embodiment, a snap lock lens cover is provided, avoiding the need for unsightly and protruding prior art screw lens fasteners. In a preferred embodiment, at least one, and more preferably two, separate snap lock projections 30 are provided on the cover which snap into apertures provided in the housing. As stated above, while a preferred embodiment of the present invention has no dedicated venting slots, it is preferred to have at least one gap 32 between a lens cover and the unit itself so as to provide an outlet for heat that may build up inside the unit. In a preferred embodiment, however, a gap 32 between the lens cover (either in the fore-front of the unit or in the pivoting connection of the lens cover) is provided for such purpose.

In a preferred embodiment, at least two, and preferably three or more, knock-out portions 34 are provided on the back side and underside of the lighting fixture in order to facilitate hard wiring of units under cabinets, etc. A spacer 36, preferably at least about ⅛ of an inch, on the underside of the fixture allows for the reduction of heat exposure to a cabinet surface to which the unit is affixed.

A switch 16 controlling the electrical operation of the unit can be of several forms, including a dimmer switch, a high/low switch or any one of a variety of switches that permit different levels of light to be provided.

Another preferred feature in various embodiments of the present invention is directed to the provision of male and/or female Molex™ connectors which allow plug-in units to be linked together with UL listed extensions. The present invention includes both hard wired and plug-in models having a power cord 38, and depending upon the consumer's preference, several colors of housing are available. Indeed, in one embodiment, the outer shell of the housing is replaceable with a different colored housing (e.g., chrome colored, white, brass, etc.). Light fixtures 10 of the present invention include single bulb embodiments, as well as duo, triple, quadruple, etc., with desired lengths of such units being available, but all preferably of a standard width, so as to be connectable to other units of different various lengths, thereby forming a relatively seamless expanse of a lighting fixture underneath long undercabinets.

While various embodiments of the present invention have been described in detail, it will be apparent that further modifications and adaptations of the invention will occur to those skilled in the art. It is to be expressly understood that such modifications and adaptations are within the spirit and scope of the present invention.

What is claimed is:

1. An under-counter lighting fixture, comprising:

a housing having a top and a bottom faces and left and right ends, said top face devoid of any ventilation vents and said bottom face having a hingedly connected single glass lens, said lens supported by a metal frame provided on a periphery of said lens;

at least one bulb connecting unit that is capable of accepting bulbs of less than about 35 watts;

at least one lens securing feature operatively connected to said metal frame and being adapted to be reversibly connected to said housing; and wherein said left and right ends have ends that have at least one angled configuration and are devoid of a continuous rounded surface extending from said top face to said bottom face.

2. An under-counter lighting fixture, comprising:

a housing having a top and a bottom faces and left and right ends having ends with at least one angled configuration, said top face devoid of any ventilation vents and said bottom face having a hingedly connected single glass lens, said lens supported by a metal frame provided on a periphery of said lens;

at least one bulb connecting unit that is capable of accepting at least one bulbs of less than about 35 watts, at least one lens securing feature reversibly connected to said metal frame, wherein said lens securing feature does not protrude from the housing.

3. The under-counter lighting fixture of claim 2, wherein said housing comprises a generally rectangular metal housing and wherein said at least one bulb is mounted inside the housing.

4. The under-counter lighting fixture of claim 2, further comprising a manually actuable rocker switch mounted to the housing for controlling the energization of the at least one bulb.

5. The under-counter lighting fixture of claim 4, wherein the manually actuable switch is mounted in an aperture in the metal housing.

6. The under-counter lighting fixture of claim 4, wherein the switch has a three-position rocker arm adapted to manually select off and two levels of brightness.

7. The under-counter lighting fixture of claim 4, wherein the switch is selected from the group consisting of a dimmer switch and a high/low switch.

8. The under-counter lighting fixture of claim 2, wherein the housing has an elongated, thin low profile shape so that it will not be visible when mounted to the underside of a cabinet.

9. The under-counter lighting fixture of claim 2, wherein the at least one bulb is part of a lamp assembly that is mounted so as to point downwardly and thus provide accent illumination on a countertop.

10. The under-counter lighting fixture of claim 9, wherein the lamp assembly is mounted in an interior of the housing.

11. The under-counter lighting fixture of claim 2, wherein the housing is made of stamped sheet metal.

12. The under-counter lighting fixture of claim 2, wherein the at least one bulb is covered by a clear or frosted diffusing lens.

13. The under-counter lighting fixture of claim 2, wherein the housing comprises an inner housing wall that is not removable.

14. The under-counter lighting fixture of claim 2, further comprising a cover that is associated with the housing through an attachment means, said attachment means being reversibly removable so as to access wiring during mounting operations of said lighting fixture.

15. The under-counter lighting fixture of claim 2, wherein said lighting fixture has side panels having an angled configuration.

16. The under-counter lighting fixture of claim 2, wherein an inside surface of the lighting fixture has a reflective coating.

17. The under-counter lighting fixture of claim 2, wherein the glass lens overlies the at least one bulb and is supported by a metal frame that extends around a periphery of the glass lens.

18. The under-counter lighting fixture of claim 2, wherein at least one gap exists between the lens and the housing so as to provide an outlet for heat that may build up inside the lighting fixture.

19. The under-counter lighting fixture of claim 2, further comprising at least two knock-out portions provided on the lighting fixture to facilitate hard wiring of the lighting fixture.

20. The under-counter lighting fixture of claim 2, wherein the lighting fixture comprises either male or female connectors to allow plug-in of other lighting fixtures, thereby permitting adjacent lighting fixtures to be linked together.

21. The under-counter lighting fixture of claim 2, wherein the lighting fixture has a standard width so that when lighting fixtures are connected, they form a relatively seamless expanse.

22. An under-counter lighting fixture, comprising: a housing having top and bottom faces and left and right ends, said top face devoid of any ventilation vents and said bottom face having a hingedly connected glass lens, said lens supported by a metal frame provided on a periphery of said lens; at least one bulb connecting unit capable of accepting bulbs of less than about 35 watts; at least one closure feature operatively connected to said metal frame and adapted to permit the reversible attachment of the glass lens to the housing; wherein said left and right ends have at least one angled configuration and are devoid of a continuous rounded surface extending from said top face to said bottom face.

23. The under-counter lighting fixture of claim 22, wherein said closure feature holds the lens cover in place when the lighting fixture is in use.

24. The under-counter lighting fixture of claim 22, wherein said housing has an elongated, thin low profile shape so that it will not be visible when mounted to the underside of a cabinet.

25. The under-counter lighting fixture of claim 22, wherein the inside of the housing has a reflective coating.

26. The under-counter lighting fixture of claim 22, further comprising male and/or female connectors adapted to permit said lighting fixture to be linked together with another lighting fixture.

27. The under-counter lighting fixture of claim 22, wherein the lighting fixture has a single bulb.

28. The under-counter lighting fixture of claim 22, wherein the lighting fixture has a standard width so as to be connectable to other lighting fixtures having different various lengths, thereby forming a relatively seamless expanse underneath long under cabinets.

* * * * *